US006346316B1

(12) United States Patent
Saito et al.

(10) Patent No.: US 6,346,316 B1
(45) **Date of Patent: *Feb. 12, 2002**

(54) PROTECTIVE LAYER TRANSFER SHEET AND PRINT

(75) Inventors: Hitoshi Saito; Shino Takao; Yuji Matsufuji, all of Tokyo-To (JP)

(73) Assignee: Dai Nippon Printing Co., Ltd. (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/382,693

(22) Filed: Aug. 25, 1999

(30) Foreign Application Priority Data

Aug. 26, 1998 (JP) ..... 10-255998
Aug. 31, 1998 (JP) ..... 10-260848

(51) Int. Cl.[7] ..... B41M 5/40; B41M 5/035; B41M 5/38

(52) U.S. Cl. ..... 428/203; 428/195; 428/204; 428/412; 428/500; 428/480; 428/913; 428/914; 503/227

(58) Field of Search ..... 428/195, 913, 428/914, 480, 412, 500, 203, 204; 503/227

(56) References Cited

U.S. PATENT DOCUMENTS 6,043,194 A * 3/2000 Saito et al. ..... 503/227

FOREIGN PATENT DOCUMENTS

| | | |
|---|---|---|
| EP | 0917964 | 5/1999 |
| EP | 0924100 | 6/1999 |
| WO | 96/14993 | 5/1996 |
| WO | 98/07577 | 2/1998 |

* cited by examiner

*Primary Examiner*—Bruce H. Hess
(74) *Attorney, Agent, or Firm*—Parkhurst & Wendel, L.L.P.

(57) ABSTRACT

There is provided a protective layer transfer sheet comprising: a substrate sheet; and a thermally transferable protective layer provided on at least a part of one side of the substrate sheet, the protective layer comprising an alicyclic polyester resin prepared using an alicyclic compound as at least one of a diol component and an acid component.

There is further provided a protective layer transfer sheet comprising: a substrate sheet; and a thermally transferable protective layer provided on at least a part of one side of the substrate sheet, the protective layer comprising a thermoplastic resin and an ultraviolet absorber, the ultraviolet absorber being a benzotriazole ultraviolet absorber represented by formula (2), the content of the ultraviolet absorber in the protective layer being 10 to 40% by weight:

(2)

wherein X and Y each independently represent an optionally branched alkyl or aralkyl group having 4 to 10 carbon atoms and Z represents a hydrogen or chlorine atom.

There is still further provided a print comprising: a substrate; and, provided on at least one side of the substrate, a dye image and a protective layer covering at least a part of the image, the protective layer having been formed by transfer from any one of the above protective layer transfer sheets.

10 Claims, 2 Drawing Sheets

PROTECTIVE LAYER TRANSFER SHEET AND PRINT

BACKGROUND OF THE INVENTION

1. Field of the Invention

The present invention relates to a protective layer transfer sheet and a print. More particularly, the present invention relates to a protective layer transfer sheet which can impart excellent fastness properties to an image in a print comprising a substrate having thereon the image, and a print having an image possessing excellent fastness properties.

2. Background Art

Halftone images and monotone images, such as letters and symbols, have hitherto been formed on a substrate by thermal transfer. Thermal transfer methods widely used in the art are thermal dye transfer and thermal ink transfer.

The thermal dye transfer is a method which comprises the steps of: providing a thermal transfer sheet comprising a substrate sheet bearing a dye layer formed of a sublimable dye as a colorant melted or dispersed in a binder resin; putting this thermal transfer sheet on the top of a substrate (optionally having a dye-receptive layer); applying energy corresponding to image information to a heating device, such as a thermal head, to transfer the sublimable dye contained in the dye layer in the thermal transfer sheet onto the substrate, thereby forming an image.

For the thermal dye transfer, the amount of the dye to be transferred can be regulated dot by dot by regulating the quantity of energy applied to the thermal transfer sheet. Therefore, excellent halftone images can be obtained. In this method, however, unlike the formation of an image by a conventional printing ink using a pigment as the colorant, a relatively low-molecular weight dye is used as the colorant, and, in addition, a vehicle is absent. For this reason, the formed image is disadvantageously poor in fastness properties, such as light fastness, weather fastness, and rubbing fastness.

A known method for solving the above drawback is to use a protective layer transfer sheet and transfer a protective layer containing an ultraviolet absorber or the like onto the formed image. The light fastness of the image can be improved to some extent by this method. However, the extent of the improvement is still unsatisfactory. Cyan dyes are particularly likely to fade. Therefore, light irradiation leads to a lowering in density of the image and, at the same time, causes a change in hue to red, resulting in remarkably deteriorated image quality.

Another problem involved in the conventional protective layer transfer sheet is that kick back is likely to be created. The kick back refers to such a phenomenon that, in the course of production of an integral transfer sheet, comprising protective layers and dye layers provided in a face serial manner on a common substrate sheet, involving a plurality of times of winding and rewinding, for example, the steps of rewinding the protective layer and the dye layer after coating, such as winding after the completion of coating, winding at the time of slittering after the coating, and winding around a bobbin as a form of a product, during storage in a wound state until next steps, the dye is first transferred (kicked) from the dye layer onto the backside of the substrate sheet, and, at the time of rewinding in the next step, the kicked dye is retransferred (backed) onto the front side of the substrate sheet facing the kicked dye. Rolls prepared in respective steps are different from one another in opposed faces. This creates a problem wherein each color dye is transferred onto the surface of the protective layer by the kick back phenomenon.

The creation of the kick back phenomenon in the transparent protective layer leads to a problem that transfer of the protective layer onto an image causes the image to be colored with the dye transferred by the kick back phenomenon, resulting in remarkably deteriorated image quality.

A further problem involved in the conventional protective layer transfer sheet is as follows. When transfer of only a smaller portion than the protective layer region in the protective layer transfer sheet onto a receptive sheet in its predetermined protective layer forming portion is contemplated, the protective layer is excessively transferred, that is, a larger portion than the contemplated portion of the protective layer in the protective layer transfer sheet is transferred. This creates the presence of an extra transferred protective layer portion not adhered to the receive layer, that is, an edge, on the outer periphery of a protective layer transferred onto the predetermined protective layer forming portion. The edge comes off the protective layer within a printer, leading to contamination of the interior of the printer and poor appearance of the print.

The present invention has been made under the above circumstances, and it is an object of the present invention to provide a protective layer transfer sheet which has excellent transferability and which can impart fastness properties, especially remarkably enhanced light fastness, to images. It is another object of the present invention to provide a print having fastness properties enhanced by the protective layer transferred from the protective layer transfer sheet.

SUMMARY OF THE INVENTION

According to one aspect of the present invention, there is provided a protective layer transfer sheet comprising: a substrate sheet; and a thermally transferable protective layer provided on at least a part of one side of the substrate sheet, the protective layer comprising an alicyclic polyester resin prepared using an alicyclic compound as at least one of a diol component and an acid component.

According to a second aspect of the present invention, there is provided a protective layer transfer sheet comprising: a substrate sheet; and a thermally transferable protective layer provided on at least a part of one side of the substrate sheet, the protective layer comprising a thermoplastic resin and an ultraviolet absorber, the ultraviolet absorber being a benzotriazole ultraviolet absorber represented by formula (2), the content of the ultraviolet absorber in the protective layer being 10 to 40% by weight:

(2)

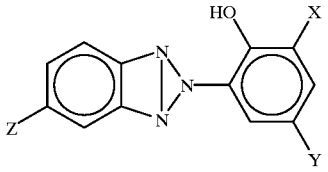

wherein X and Y each independently represent an optionally branched alkyl or aralkyl group having 4 to 10 carbon atoms and Z represents a hydrogen or chlorine atom.

Further, according to a further aspect of the present invention, there is provided a print comprising: a substrate; and, provided on at least one side of the substrate, a dye image and a protective layer covering at least a part of the image, the protective layer having been formed by transfer from any one of the above protective layer transfer sheets.

In the protective layer transfer sheet according to the first aspect of the present invention, the alicyclic polyester resin imparts excellent light fastness and good transferability [a capability of being faithfully transferred onto a predetermined protective layer forming region (that is, a predetermined region on which the protective layer is to be transferred; this region being hereinafter often referred to as "predetermined transfer portion") in a receptive sheet] to the protective layer, and the protective layer in the protective layer transfer sheet is much less likely to create kick back. Transfer of this protective layer onto images can prevent dyes constituting the images from being faded by light and thus can impart excellent light fastness to printed images.

In the protective layer transfer sheet according to the second aspect of the present invention, the protective layer has excellent ultraviolet absorption. Transfer of this protective layer onto images can prevent dyes constituting the images from being faded by light and thus can impart excellent light fastness to printed images.

DETAILED DESCRIPTION OF THE INVENTION

Embodiments of the present invention will be described with reference to the accompanying drawings.

Protective Layer Transfer Sheet

FIGS. 1 to 6 are schematic cross-sectional views showing embodiments of the protective layer transfer sheet according to the present invention.

Figure 1:
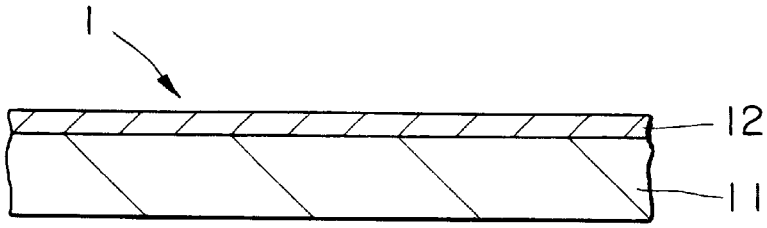
FIG. 1 is a schematic cross-sectional view showing one embodiment of the protective layer transfer sheet according to the present invention.

A protective layer transfer sheet 1, according to the present invention, shown in FIG. 1 is an embodiment having the simplest layer construction. In this layer construction, a thermally transferable protective layer 12 is provided on one side of a substrate sheet 11.

Figure 2:
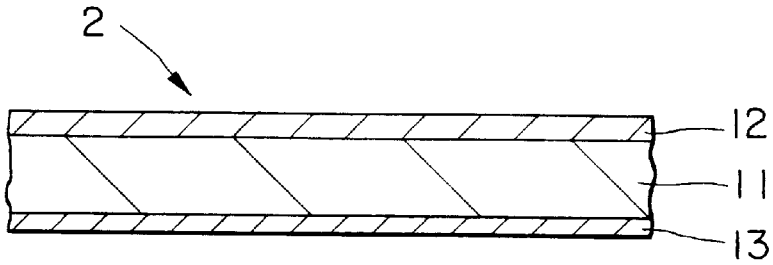
FIG. 2 is a schematic cross-sectional view showing another embodiment of the protective layer transfer sheet according to the present invention.

A protective layer transfer sheet 2, according to the present invention, shown in FIG. 2 has the same layer construction as the protective layer transfer sheet 1 shown in FIG. 1, except that a backside layer 13 is provided on the substrate sheet 11 in its side remote from the thermally transferable protective layer 12.

Figure 3:
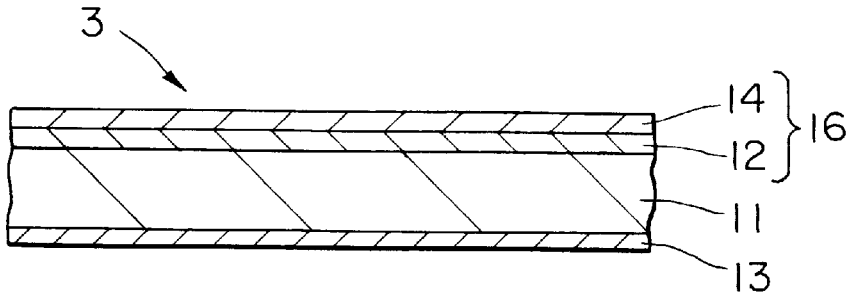
FIG. 3 is a schematic cross-sectional view showing still another embodiment of the protective layer transfer sheet according to the present invention.

A protective layer transfer sheet 3, according to the present invention, shown in FIG. 3 has a laminate structure comprising: a substrate sheet 11; a thermally transferable transfer layer 16 provided on one side of a substrate sheet 11; and a backside layer 13 provided on the other side of the substrate sheet 11, the transfer layer 16 comprising a protective layer 12 and an adhesive layer 14 provided in that order from the substrate sheet 11 side.

Figure 4:
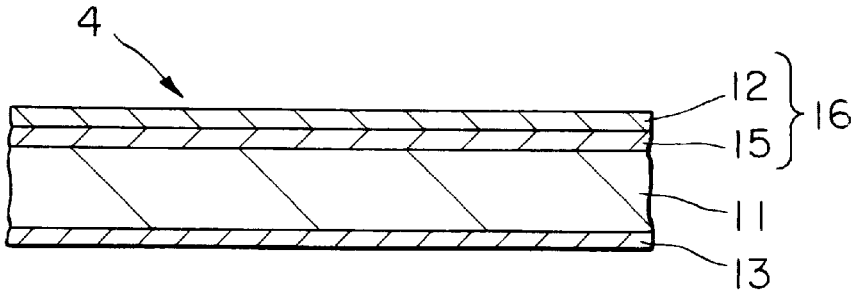
FIG. 4 is a schematic cross-sectional view showing a further embodiment of the protective layer transfer sheet according to the present invention.

A protective layer transfer sheet 4, according to the present invention, shown in FIG. 4 has a laminate structure comprising: a substrate sheet 11; a thermally transferable transfer layer 16 provided on one side of a substrate sheet 11; and a backside layer 13 provided on the other side of the substrate sheet 11, the transfer layer 16 comprising a functional layer 15 and a protective layer 12 provided in that order from the substrate sheet 11 side.

Figure 5:
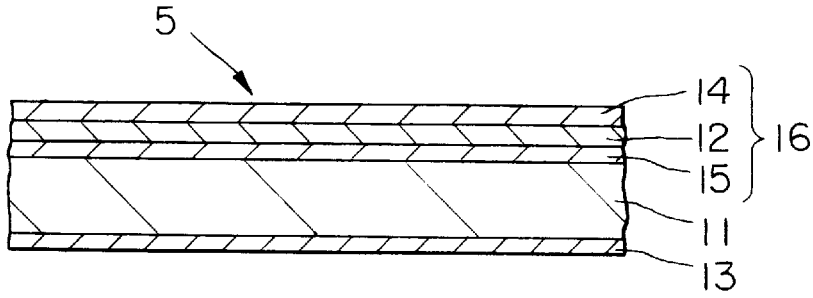
FIG. 5 is a schematic cross-sectional view showing a still further embodiment of the protective layer transfer sheet according to the present invention.

A protective layer transfer sheet 5, according to the present invention, shown in FIG. 5 has a laminate structure comprising: a substrate sheet 11; a thermally transferable transfer layer 16 provided on one side of a substrate sheet 11; and a backside layer 13 provided on the other side of the substrate sheet 11, the transfer layer 16 comprising a functional layer 15, a protective layer 12, and an adhesive layer 14 provided in that order from the substrate sheet 11 side.

Figure 6:
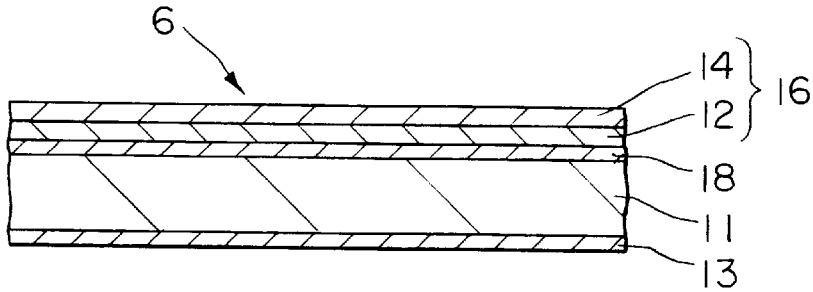
FIG. 6 is a schematic cross-sectional view showing another embodiment of the protective layer transfer sheet according to the present invention.

A protective layer transfer sheet 6, according to the present invention, shown in FIG. 6 has the same layer construction as the protective layer transfer sheet 3 shown in FIG. 3, except that a release layer 18 is provided between the substrate sheet 11 and the protective layer 12. Also in the protective layer transfer sheets 1, 2, 4, and 5, the release layer 18 may be optionally provided between the protective layer 12 or the transfer layer 16 and the substrate sheet 11. The release layer 18 is constructed so that, when the protective layer 12 or the transfer layer 16 is thermally transferred, the release layer 18 per se is left on the substrate sheet 11 side.

In the protective layer transfer sheets 4 and 5, when the functional layer 15 has a multi-layer structure, the protective layer 12 may be provided between layers constituting the functional layer 15.

Next, layers constituting the protective layer transfer sheet of the present invention will be described.

(1) Substrate Sheet

In the protective layer transfer sheet of the present invention, the substrate sheet 11 may be any substrate sheet used in conventional protective layer transfer sheets. Specific examples of preferred substrate sheets include tissue papers, such as glassine paper, capacitor paper, and paraffin paper; highly heat-resistant stretched or unstretched films of plastics, for example, polyesters, such as polyethylene terephthalate, polyethylene naphthalate, and polybutylene terephthalate, polyphenylene sulfide, polyether ketone, polyethersulfone, polypropylene, polycarbonate, cellulose acetate, derivatives of polyethylene, polyvinyl chloride, polyvinylidene chloride, polystyrene, polyamide, polyimide, polymethylpentene, and ionomers; materials prepared by subjecting the above materials to treatment for improving the adhesion; and laminates of the above materials. The thickness of the substrate sheet 11 is suitably determined depending upon materials for the substrate sheet so that the substrate sheet has proper strength, heat resistance and other properties. In general, however, the thickness is preferably about 1 to 100 $\mu$m.

(2) Protective Layer

The protective layer in the protective layer transfer sheet according to the present invention comprises, as an indispensable component in the first aspect of the present invention and as a preferred component in the second aspect of the present invention, an alicyclic polyester resin prepared using an alicyclic compound as at least one of a diol component and an acid component. The content of the alicyclic polyester resin is preferably not less than 30% by weight, more preferably not less than 50% by weight, based on the resin component contained in the protective layer. When the content of the alicyclic polyester resin is less than 30% by weight, incorporation of a resin having poor transferability as other resin component is likely to render the transferability of the protective layer unsatisfactory.

The alicyclic compound, when used as the acid component, may be any alicyclic compound so far as it has two or more carboxyl groups. On the other hand, the alicyclic compound, when used as the diol component, may be any alicyclic compound so far as it has two or more hydroxyl groups. According to the present invention, examples of preferred alicyclic compounds include tricyclodecanedimethanol (TCD-M), cyclohexanedicarboxylic acid, cyclohexanedimethanol, and cyclohexanediol. Examples of particularly preferred diols include tricyclo[5.2.1.$0^{2,6}$] decane-4,8-dimethanol.

According to the present invention, so far as the alicyclic compound is used as one of the diol component and the acid component, other diol and acid components may be used in combination therewith. Other diols usable herein include, for example, ethylene glycol, neopentyl glycol, diethylene glycol, propylene glycol, dipropylene glycol, tripropylene glycol, 2,3,4-trimethyl-1,3-pentanediol, 3-methylpentene-1, 5-diol, 1,4-cyclohexanedimethanol, ethylene oxide or propylene oxide adducts of bisphenol A or hydrogenated bisphenol A, polyethylene glycol, polypropylene glycol, polytetramethylene glycol, polybutylene glycol, 2,2-diethyl-1,3-propanediol, 2-n-butyl-ethyl-1,3-propanediol. These other diols may be used in an amount of 0 to 90% by weight based on the whole diol component.

Other acid components usable herein include, for example, aromatic dicarboxylic acids, such as terephthalic acid, isophthalic acid, o-phthalic acid, and 2,6-naphthalic acid, aromatic oxycarboxylic acids, such as p-oxybenzoic acid, p-(hydroxyethoxy)benzoic acid, aliphatic dicarboxylic acids, such as succinic acid, adipic acid, azelaic acid, sebacic acid, and dodecanedicarboxylic acid, unsaturated aliphatic and alicyclic dicarboxylic acids, such as fumaric acid, maleic acid, itaconic acid, tetrahydrophthalic acid, 1,4-cyclohexanedicarboxylic acid, and tri- and tetracarboxylic acids, such as trimellitic acid, trimesic acid, and pyromellitic acid. Among these polycarboxylic acids, aromatic dicarboxylic acids are particularly preferred. The polyester may be produced by a method already known per se, such as dehydrocondensation or transesterification condensation. Preferably, the polyester resin has a viscosity average molecular weight of 1,000 to 10,000 and a glass transition temperature Tg of 80° C. or above. In the case of a viscosity average molecular weight is less than 1,000, properties of a polymer are reduced, and properties of an oligomer appear. Therefore, a coating formed from this polyester resin has poor mechanical strength and hence is unsuitable as the protective layer. On the other hand, when the viscosity average molecular weight exceeds 10,000, the transferability is unfavorably lowered. A glass transition temperature Tg below 80° C. unfavorably leads to the development of kick back, described below, in the protective layer transfer sheet.

According to the present invention, the alicyclic polyesters may be used as such or after modification, such as urethanization. Further, they may be used alone or as a mixture of two or more.

The alicyclic polyester resin has excellent transferability, and can impart excellent light fastness particularly to cyan dyes. As described below, transfer of the protective layer on an image in a print can more effectively prevent dyes constituting the image from being faded by light. Further, this can solve a problem of the conventional protective layer transfer sheet. Specifically, the conventional protective layer transfer sheet has unsatisfactory light fastness, and, since cyan dyes are particularly likely to fade, light irradiation leads to a lowering in density of the image and, at the same time, causes a change in hue to red, resulting in remarkably deteriorated image quality. The protective layer according to the present invention can solve this problem, and can impart excellent fastness properties to the image. Further, when the alicyclic polyester resin has a glass transition temperature Tg of 80° C. or above, the kick back in the protective layer transfer sheet can be effectively prevented. The term "kick back" used herein refers to such a phenomenon that, in the course of production of an integral transfer sheet, comprising protective layers and dye layers provided in a face serial manner on a common substrate sheet, involving a plurality of times of winding and rewinding, for example, the steps of rewinding the protective layer and the dye layer after coating, such as winding after the completion of coating and winding at the time of slittering after the coating, a part of the dye is first transferred (kicked) from the dye layer onto the backside of the substrate sheet, and, at the time of rewinding in the next step, the kicked dye is retransferred (backed) onto the protective layer.

The protective layer according to the present invention may further comprise 25 to 75% by weight of a thermoplastic resin, having a glass transition temperature Tg of 80° C. or above, selected from acrylic resins, styrene resins, polyvinyl acetal resins, aromatic polycarbonate resins, and polyester resins other than the above alicyclic polyester resins. Incorporation of these resins can further improve fastness properties, for example, the abrasion resistance and the scratch resistance, of the protective layer.

The protective layer according to the present invention may contain 5 to 50% by weight of a random copolymer, having a glass transition temperature Tg of generally 60° C. or above, preferably 80° C. or above, of a reactive ultraviolet absorber with an acrylic monomer from the viewpoint of further improving the ultraviolet absorption.

The reactive ultraviolet absorber may be one prepared by introducing, for example, an addition-polymerizable double bond of a vinyl, acryloyl, or methacryloyl group or an alcoholic hydroxyl, amino, carboxyl, epoxy, or isocyanate group into a nonreactive ultraviolet absorber, for example, a conventional organic ultraviolet absorber, such as a salicylate, benzophenone, benzotriazole, substituted acrylonitrile, nickel chelate, or hindered amine nonreactive ultraviolet absorber.

Acrylic monomers usable herein include the following compounds:

methyl acrylate, methyl methacrylate, ethyl acrylate, ethyl methacrylate, propyl acrylate, propyl methacrylate, butyl acrylate, butyl methacrylate, isobutyl acrylate, isobutyl methacrylate, tert-butyl acrylate, tert-butyl methacrylate, isodecyl acrylate, isodecyl methacrylate, lauryl acrylate, lauryl methacrylate, lauryltridecyl acrylate, lauryltridecyl methacrylate, tridecyl acrylate, tridecyl methacrylate, cerylstearyl acrylate, cerylstearyl methacrylate, stearyl acrylate, stearyl methacrylate, ethylhexyl acrylate, ethylhexyl methacrylate, octyl acrylate, octyl methacrylate, cyclohexyl acrylate, cyclohexyl methacrylate, benzyl acrylate, benzyl methacrylate, methacrylic acid, hydroxyethyl acrylate, hydroxyethyl methacrylate, hydroxypropyl acrylate, hydroxypropyl methacrylate, dimethylaminoethyl acrylate, dimethylaminoethyl methacrylate, diethylaminoethyl acrylate, diethylaminoethyl methacrylate, tert-butylaminoethyl acrylate, tert-butylaminoethyl methacrylate, glycidyl acrylate, glycidyl methacrylate, tetrahydrofurfuryl acrylate, tetrahydrofurfuryl methacrylate, ethylene diacrylate, ethylene dimethacrylate, diethylene glycol diacrylate, diethylene glycol dimethacrylate, triethylene glycol diacrylate, triethylene glycol dimethacrylate, tetraethylene glycol diacrylate, tetraethylene glycol dimethacrylate, decaethylene glycol diacrylate, decaethylene glycol dimethacrylate, pentadecaethylene glycol diacrylate, pentadecaethylene glycol dimethacrylate, pentacontahectaethylene glycol diacrylate, pentacontahectaethylene glycol dimethacrylate, butylene diacrylate, butylene dimethacrylate, allyl acrylate, allyl methacrylate, trimethylolpropane triacrylate, trimethylolpropane trimethacrylate, hexanediol diacrylate, hexanediol dimethacrylate, tripropylene glycol diacrylate, tripropylene glycol dimethacrylate, pentaerythritol tetraacrylate, pentaerythritol tetramethacrylate, dipentaerythritol hexaacrylate, dipentaerythritol hexamethacrylate, 1,6-hexanediol diacrylate, 1,6-hexanediol dimethacrylate, neopentylglycol pentaacrylate, neopentylglycol pentamethacrylate, phosphazene hexaacrylate, and phosphazene hexamethacrylate. These acrylic monomers may be used alone or as a mixture of two or more.

The content of the reactive ultraviolet absorber in the random copolymer of the reactive ultraviolet absorber with the acrylic monomer is generally 10 to 90% by weight, preferably 30 to 70% by weight. The molecular weight of the random copolymer is generally about 5,000 to 250,000, preferably about 9,000 to 30,000.

Examples of the random copolymer of the reactive ultraviolet absorber with the acrylic monomer include, but are not limited to, those represented by formula (1):

(1)

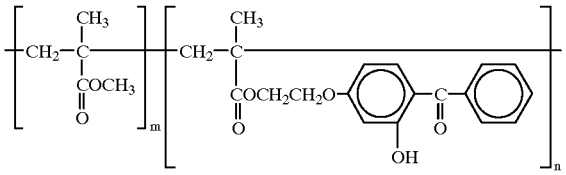

wherein m and n are each an integer.

The protective layer in the protective layer transfer sheet according to the present invention contains a benzotriazole ultraviolet absorber represented by formula (2) as an indispensable component in the second aspect of the present invention and as a preferred component in the first aspect of the present invention:

(2)

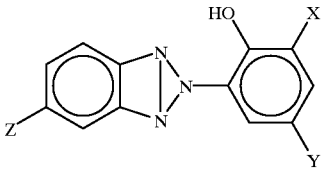

wherein X and Y each independently represent an optionally branched alkyl or aralkyl group having 4 to 10 carbon atoms and Z represents a hydrogen or chlorine atom.

In the benzotriazole ultraviolet absorber, when X and Y have less than 4 carbon atoms, the compatibility thereof with the thermoplastic resin is poor. This causes the precipitation or agglomeration of the ultraviolet absorber which renders the ultraviolet absorption effect unsatisfactory. On the other hand, when X and Y have more than 10 carbon atoms, the ultraviolet absorber unfavorably plasticizes the thermoplastic resin. In this case, a coating formed from the thermoplastic resin has poor mechanical strength and is unsuitable as the protective layer. Further, when protective layer transfer sheets are stored in a stacked state, blocking is likely to occur upon contact of the protective layer of one protective layer transfer sheet with the backside of another protective layer transfer sheet.

When this benzotriazole ultraviolet absorber is used, the content thereof in the protective layer is generally 10 to 40% by weight, preferably 25 to 35% by weight. When the content of the benzotriazole ultraviolet absorber is less than 10% by weight, the ultraviolet absorption of the protective layer is unsatisfactory. On the other hand, when the content exceeds 40% by weight, the precipitation or agglomeration of the ultraviolet absorber unfavorably occurs, rendering the ultraviolet absorption effect unsatisfactory.

The thickness of the protective layer 12 is generally in the range of 0.5 to 10 $\mu$m. When the thickness of the protective layer 12 is less than 0.5 $\mu$m, the ultraviolet absorption of the protective layer 12 is unsatisfactory and, in addition, the strength of the protective layer 12 is unsatisfactory. On the other hand, a thickness exceeding 10 $\mu$m unfavorably results in lowered transferability of the protective layer or is cost-ineffective due to the excess layer thickness.

(3) Adhesive Layer

The adhesive layer 14 functions to facilitate the transfer of the protective layer 12 onto an object. Adhesives usable for the adhesive layer include (meth)acrylate, styrene/(meth) acrylate, vinyl chloride, styrene/vinyl chloride/vinyl acetate copolymer, vinyl chloride/vinyl acetate copolymer, polyester, polyamide and other hot-melt adhesives. The adhesive layer may be formed by a conventional method, such as gravure coating, gravure reverse coating, or roll coating. The thickness of the adhesive layer is preferably about 0.1 to 5 $\mu$m.

In the above embodiment, the adhesive layer 14 may contain not more than 70% by weight of the random copolymer, represented by formula (1), of the ultraviolet absorber with the acrylic monomer and/or not more than 40% by weight of the ultraviolet absorber represented by formula (2).

(4) Functional Layer

The functional layer 15 functions to add values to prints after the transfer of the protective layer. Added values include, for example, matte images and those disclosed in Japanese Patent Laid-Open No. 324140/1996, such as writing quality/marking quality, security, design, solvent resistance, plasticizer resistance, abrasion resistance/scratch resistance, and antistatic properties.

Specific examples of functional layers include: hologram layers; transparency character/image layers; various coatings, for example, coatings formed from aqueous coating liquids, coatings which have been three-dimensionally cured by actinic radiations (heat, ultraviolet light or the like), and coatings of various resins, such as acrylic resins, polyimides, and polycarbonates, and layers of these resins with various organic and/or inorganic fillers, conductive fillers, or antistatic agents incorporated therein; and conductive resin layers. Further, at a position which becomes the outermost surface after the transfer, a functional layer formed of a thermoplastic resin may be provided using a matte-finished substrate sheet 11 (in the case of the sheet shown in FIGS. 4 and 5) or using a release layer 18 (in the case of the sheet shown in FIG. 6).

The functional layer 15 may have a single-layer structure or a multi-layer structure. In the case of the multi-layer structure, the protective layer 12 may be provided between layers constituting the functional layer.

The functional layer may be formed by conventional means, such as gravure coating, gravure reverse coating, or roll coating. The thickness of the functional layer is preferably about 0.1 to 5 μm.

In the above embodiment, the functional layer may contain not more than 70% by weight of the random copolymer, represented by formula (1), of the ultraviolet absorber with the acrylic monomer and/or not more than 40% by weight of the ultraviolet absorber represented by formula (2).

(5) Backside Layer

The backside layer 13 is provided to prevent heat blocking between a heating device, such as a thermal head, and the substrate sheet 11 and to improve the slip property of the protective layer transfer sheet. Resins usable in the backside layer 13 include naturally occurring and synthetic resins, for example, cellulosic resins, such as ethylcellulose, hydroxycellulose, hydroxypropylcellulose, methylcellulose, cellulose acetate, cellulose acetate butyrate, and nitrocellulose, vinyl resins, such as polyvinyl alcohol, polyvinyl acetate, polyvinyl butyral, polyvinyl acetal, and polyvinyl pyrrolidone, acrylic resins, such as polymethyl methacrylate, polyethyl acrylate, polyacrylamide, and acrylonitrile/styrene copolymer, polyamide resin, polyvinyltoluene resin, coumarone-indene resin, polyester resin, polyurethane resin, silicone-modified or fluorine-modified urethane. They may be used alone or as a mixture of two or more. In order to enhance the heat resistance of the backside layer 13, the backside layer 13 is preferably constituted by a crosslinked resin layer formed by using a resin having a hydroxyl reactive group among the above resins in combination with polyisocyanate or the like as a crosslinking agent.

Further, from the viewpoint of imparting slidability of the protective layer transfer sheet on the thermal head, a solid or liquid release agent or lubricant may be added to the backside layer 13 to provide heat slip properties. Release agents or lubricants usable herein include, for example, various waxes, such as polyethylene wax and paraffin waxes, higher aliphatic alcohols, organopolysiloxanes, anionic surfactants, cationic surfactants, amphoteric surfactants, nonionic surfactants, fluorosurfactants, organic carboxylic acids and derivatives thereof, fluororesins, silicone resins, and fine particles of inorganic compounds, such as talc and silica. The content of the release agent or the lubricant in the backside layer 6 is generally about 5 to 50% by weight, preferably about 10 to 30% by weight.

The thickness of the backside layer 13 is generally about 0.1 to 10 μm, preferably about 0.5 to 5 μm.

(6) Release Layer

The release layer 18 is provided when, in a combination of the substrate sheet 11 with the protective layer 12, the releasability of the protective layer 12 at the time of the thermal transfer of the protective layer is unsatisfactory. For example, the release layer 18 may be formed of a release agent, for example, a wax, such as a silicone wax, or a silicone resin. Alternatively, the material for the release layer may be properly selected, without particular limitation, from hydrophilic resins disclosed in Japanese Patent Laid-Open No. 142988/1992 and various curable resins according to properties of the substrate sheet and the protective layer. The release layer 18 may be formed by coating an ink, prepared by dissolving or dispersing the release agent and an optional additive in a suitable solvent, onto the substrate sheet 11 by a conventional method and then drying the coating. The thickness of the release layer is preferably about 0.1 to 5 μm.

Figure 7:
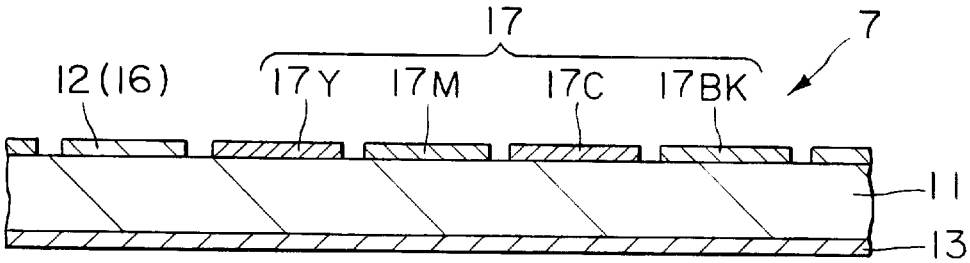
FIG. 7 is a schematic cross-sectional view showing a further embodiment of the protective layer transfer sheet according to the present invention.

FIG. 7 is a schematic cross-sectional view showing a further embodiment of the protective layer transfer sheet according to the present invention. In FIG. 7, the protective layer transfer sheet 7 is an integral protective layer transfer sheet, used in thermal dye transfer, which serves both as a protective layer transfer sheet and a thermal dye transfer sheet. The protective layer transfer sheet 7 comprises: a substrate sheet 11; a protective layer 12 or a transfer layer 16 and a dye layer 17 provided in a face serial manner on one side of the substrate sheet 11; and a backside layer 13 provided on the other side of the substrate sheet 11.

The substrate sheet 11, the protective layer 12, the backside layer 13, and the transfer layer 16 may be the same as those described above. Further, as described above, the release layer 18 may be provided between the substrate sheet 11 and the protective layer 12.

The dye layer 17 is constituted by dye layers 17Y, 17M, 17C, and 17BK respectively having hues of yellow, magenta, cyan, and black. The dye layer 17 (17Y, 17M, 17C, and 17BK) comprises at least a dye and a binder resin.

Dyes usable herein include, but are not particularly limited to, dyes commonly used in conventional thermal transfer sheets for thermal dye transfer, such as azo, azomethine, methine, anthraquinone, quinophthalone, and naphthoquinone dyes. Various dyes as described above may be combined to form a dye layer having any desired hue of black or the like.

Binder resins usable for holding the dye in the dye layer 17 include conventional binders, for example, cellulosic resins, such as ethylcellulose, hydroxyethylcellulose, hydroxypropylcellulose, methylcellulose, cellulose acetate, and cellulose acetate butyrate, vinyl resins, such as polyvinyl alcohol, polyvinyl acetate, polyvinyl butyral, polyvinyl acetal, polyvinyl pyrrolidone, and polyacrylamide, and polyesters. Among them, cellulosic, acetal, butyral, and polyester binder resins are preferred from the viewpoint of heat resistance and transferability of dyes.

Further, any conventional release agent may be contained in the dye layer 17 from the viewpoint of preventing heat blocking between the binder for the dye layer and a resin in a receptive layer at the time of printing. Specific examples of release agents usable herein include various waxes, such as polyethylene wax and paraffin wax, higher aliphatic alcohols, organopolysiloxanes, various surfactants, various phosphoric esters, fluororesins, and silicone resins.

The dye layer 17 may be formed by coating an ink, prepared by dissolving or dispersing the sublimable dye, the binder resin, and an optional additive in a suitable solvent, onto the substrate sheet by a conventional method and then drying the coating. The thickness of the dye layer 17 is generally about 0.2 to 5 μm, preferably 0.4 to 2 μm. The content of the sublimable dye in the dye layer 17 is generally 5 to 90% by weight, preferably 10 to 70% by weight.

In the protective layer transfer sheet 5, the protective layer 12, 17Y, 17M, 17C, and 17BK are provided in that order in a face serial manner. The construction of the protective layer transfer sheet according to embodiment is not limited to this only. The dye layer 17BK for black may be omitted. Further, the dye layer 17 (17Y, 17M, 17C, and 17BK) may partially or entirely have a two-layer structure.

The protective layer transfer sheet according to the present invention is not limited to the above embodiments and may be varied or modified as desired according to applications and the like. In particular, when the protective layer transfer sheet is in the form of a composite type protective layer transfer sheet, the formation of an image by thermal transfer can be carried out simultaneously with the transfer of a protective layer onto a print.

Print

The print of the present invention will be described.

Figure 8:
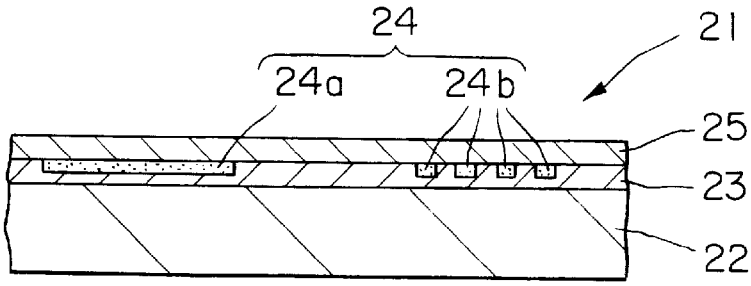
FIG. 8 is a schematic cross-sectional view showing one embodiment of the print according to the present invention.

FIG. 8 is a schematic cross-sectional view showing one embodiment of the print according to the present invention. In FIG. 8, the print 21 comprises: a substrate 22 bearing a dye-receptive layer 23; an image 24 which has been recorded by thermal dye transfer onto the dye-receptive layer 23 provided on the substrate 22; and a protective layer 25 covering the image 24. The image 24 may comprise a full-color image 24*a* of three colors of yellow, magenta, cyan, or four colors of yellow, magenta, cyan, and black, and a monotone image 24*b* of a letter, a symbol or the like.

In the print 21 shown in FIG. 8, the image 24 is entirely covered with the protective layer 25. The protective layer 25 may be formed by transferring the protective layer 12 or the transfer layer 16 in the protective layer transfer sheet of the present invention so as to cover the image 24. In this case, since the protective layer 12 has good layer transferability, the protective layer 25 can be transferred and formed in a desired pattern by transfer. Further, by virtue of the provision of the protective layer 25 on the image 24, the print 21 of the present invention possesses good fastness properties, such as good light fastness, weather fastness, and rubbing fastness.

The following examples further illustrate the present invention but are not intended to limit it.

Experiment I

Preparation of Resin Compositions

At the outset, the following six polyester resins (PEs-1 to PEs-6) were prepared by conventional methods.

| PEs-1: Tg = 92° C., viscosity average molecular weight = 5,000) | |
|---|---|
| Diethylene glycol | 10 mol % |
| Tricyclodecanedimethanol (TCD-M) | 90 mol % |
| Terephthalic acid | 50 mol % |
| Isophthalic acid | 50 mol % |
| PEs-2: Tg = 67° C., viscosity average molecular weight = 15,000) | |
| Diethylene glycol | 60 mol % |
| Neopentyl glycol | 20 mol % |
| Cyclohexanedimethanol | 20 mol % |
| Terephthalic acid | 65 mol % |
| Isophthalic acid | 35 mol % |
| PEs-3: Tg = 73° C., viscosity average molecular weight = 15,000) | |
| Diethylene glycol | 60 mol % |
| Tricyclodecanedimethanol (TCD-M) | 20 mol % |
| Cyclohexanedimethanol | 20 mol % |
| Terephthalic acid | 60 mol % |
| Isophthalic acid | 40 mol % |
| PEs-4: Tg = 52° C., viscosity average molecular weight = 20,000) | |
| Diethylene glycol | 60 mol % |
| Cyclohexanedimethanol | 40 mol % |
| Cyclohexanedicarboxylic acid | 30 mol % |
| Terephthalic acid | 30 mol % |
| Isophthalic acid | 40 mol % |

-continued

| PEs-5: Tg = 47° C., viscosity average molecular weight = 15,000) | |
|---|---|
| Diethylene glycol | 50 mol % |
| Neopentyl glycol | 50 mol % |
| Terephthalic acid | 47 mol % |
| Isophthalic acid | 42 mol % |
| Sebacic acid | 11 mol % |
| PEs-6: Tg = 72° C., viscosity average molecular weight = 20,000) | |
| Diethylene glycol | 50 mol % |
| Ethylene oxide adduct of bisphenol A | 50 mol % |
| Terephthalic acid | 50 mol % |
| Isophthalic acid | 50 mol % |

A random copolymer (PC-1: Tg=130° C., viscosity average molecular weight=22,400) comprising 40% by mole of constituent units represented by formula (3) and 60% by mole of constituent units represented by formula (4) was prepared by a conventional method:

(3)

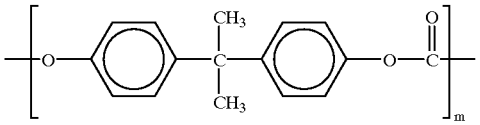

(4)

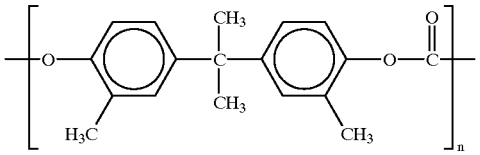

The glass transition temperature Tg and the viscosity average molecular weight of the polyester resins (PEs-1 to PEs-6) and the polycarbonate resin (PC-1) were measured by the following methods.

Glass Transition Temperature

The glass transition temperature was measured with a differential scanning calorimeter DSC-50 (manufactured by Shimadzu Seisakusho Ltd.) according to JIS K 7121.

Viscosity Average Molecular Weight

The viscosity average molecular weight was determined from reduced viscosity by a conventional method.

Preparation of Coating Liquids for Protective Layer and Coating Liquids for Release Layer The following coating liquids 1 to 11 for a protective layer and the following coating liquids for a release layer were prepared according to the following formulations.

| Coating liquid 1 for protective layer | |
|---|---|
| Polyester resin (PEs-1) | 20 pts. wt. |
| Methyl ethyl ketone/toluene = 1/1 (weight ratio) | 80 pts. wt. |
| Coating liquid 2 for protective layer | |
| Polyester resin (PEs-2) | 15 pts. wt. |
| Acrylic copolymer as ultraviolet absorber (UVA 635L, manufactured by BASF Japan) | 5 pts. wt. |
| Methyl ethyl ketone/toluene = 1/1 (weight ratio) | 80 pts. wt. |

-continued

| Coating liquid 3 for protective layer | |
|---|---|
| Polyester resin (PEs-3) | 20 pts. wt. |
| Benzotriazole ultraviolet absorber (TINUVIN 234, manufactured by CIBA-GEIGY (Japan) Ltd.) | 10 pts. wt. |
| Methyl ethyl ketone/toluene = 1/1 (weight ratio) | 80 pts. wt. |
| **Coating liquid 4 for protective layer** | |
| Polyester resin (PEs-4) | 10 pts. wt. |
| Acrylic copolymer as ultraviolet absorber (UVA 635L, manufactured by BASF Japan) | 4 pts. wt. |
| Benzotriazole ultraviolet absorber (TINUVIN 234, manufactured by CIBA-GEIGY (Japan) Ltd.) | 10 pts. wt. |
| Methyl ethyl ketone/toluene = 1/1 (weight ratio) | 80 pts. wt. |
| **Coating liquid 5 for protective layer** | |
| Polyester resin (PEs-1) | 10 pts. wt. |
| Polycarbonate resin (PC-1) | 6 pts. wt. |
| Acrylic copolymer as ultraviolet absorber (UVA 635L, manufactured by BASF Japan) | 4 pts. wt. |
| Benzotriazole ultraviolet absorber (TINUVIN 234, manufactured by CIBA-GEIGY (Japan) Ltd.) | 10 pts. wt. |
| Methyl ethyl ketone/toluene = 1/1 (weight ratio) | 80 pts. wt. |
| **Coating liquid 6 for protective layer** | |
| Polyester resin (PEs-1) | 10 pts. wt. |
| Polyvinyl acetal resin(S-lec KS-1, manufactured by Sekisui Chemical Co., Ltd.) | 6 pts. wt. |
| Acrylic copolymer as ultraviolet absorber (UVA 635L, manufactured by BASF Japan) | 4 pts. wt. |
| Benzotriazole ultraviolet absorber (TINUVIN 234, manufactured by CIBA-GEIGY (Japan) Ltd.) | 10 pts. wt. |
| Methyl ethyl ketone/toluene = 1/1 (weight ratio) | 80 pts. wt. |
| **Coating liquid 7 for protective layer** | |
| Polyester resin (PEs-5) | 20 pts. wt. |
| Methyl ethyl ketone/toluene = 1/1 (weight ratio) | 80 pts. wt. |
| **Coating liquid 8 for protective layer** | |
| Polyester resin (PEs-5) | 15 pts. wt. |
| Acrylic copolymer as ultraviolet absorber (UVA 635L, manufactured by BASF Japan) | 5 pts. wt. |
| Methyl ethyl ketone/toluene = 1/1 (weight ratio) | 80 pts. wt. |
| **Coating liquid 9 for protective layer** | |
| Polyester resin (PEs-6) | 20 pts. wt. |
| Benzotriazole ultraviolet absorber (TINUVIN 328, manufactured by CIBA-GEIGY (Japan) Ltd.) | 10 pts. wt. |
| Methyl ethyl ketone/toluene = 1/1 (weight ratio) | 80 pts. wt. |
| **Coating liquid 10 for protective layer** | |
| Acrylic resin (Dianal BR-75, manufactured by Mitsubishi Rayon Co., Ltd. | 20 pts. wt. |
| Methyl ethyl ketone/toluene = 1/1 (weight ratio) | 80 pts. wt. |
| **Coating liquid 11 for protective layer** | |
| Vinyl chloride/vinyl acetate copolymer (Denka Vinyl #1000ALK, manufactured by Denki Kagaku Kogyo K.K.) | 20 pts. wt. |
| Benzotriazole ultraviolet absorber (TINUVIN 328, manufactured by CIBA-GEIGY (Japan) Ltd.) | 10 pts. wt. |
| Methyl ethyl ketone/toluene = 1/1 (weight ratio) | 80 pts. wt. |

-continued

| Coating liquid for release layer | |
|---|---|
| Ionomer resin (manufactured by Mitsui Chemical Co. Ltd.) | 10 pts. wt. |
| Water/ethanol = 2/3 (weight ratio) | 100 pts. wt. |

Preparation of Thermal Transfer Image-Receiving Sheet

A 150 μm-thick synthetic paper (YUPO FPG#150, manufactured by Oji-Yuka Synthetic Paper Co., Ltd.) was provided as a substrate sheet. A coating liquid, for a receptive layer, having the following compositions was coated on one side of the substrate sheet by wire bar coating (coverage 5.0 g/m$^2$ on solid basis), and the coating was dried at 110° C. for 30 sec. Thus, a thermal transfer image-receiving sheet was prepared.

| Coating liquid for receptive layer | |
|---|---|
| Vinyl chloride/vinyl acetate copolymer (Denka Vinyl #1000A, manufactured by Denki Kagaku Kogyo K.K.) | 10 pts. wt. |
| Epoxy-modified silicone (X-22-3000T, manufactured by The Shin-Etsu Chemical Co., Ltd) | 1 pt. wt. |
| Methyl ethyl ketone/toluene = 1/1 (weight ratio) | 40 pts. wt. |

Preparation of Protective Layer Transfer Sheet

EXAMPLE I-1

An ink, for a backside layer, having the following composition was coated by gravure coating on one side of a 6 μm-thick polyethylene terephthalate film (Lumirror, manufactured by Toray Industries, Inc.). The coating was then dried and heat-cured to form a backside layer (thickness 1 μm).

| Composition of ink for backside layer | |
|---|---|
| Polyvinyl butyral resin (S-lec BX-1, manufactured by Sekisui Chemical Co., Ltd.) | 3.6 pts. wt. |
| Polyisocyanate (Burnock D750-45, manufactured by Dainippon Ink and Chemicals, Inc.) | 19.2 pts. wt. |
| Phosphoric ester surfactant (Plysurf A208S, manufactured by Dai-Ichi Kogyo Seiyaku Co., Ltd.) | 2.9 pts. wt. |
| Phosphoric ester surfactant (Phosphanol RD720, manufactured by Toho Chemical Industry Co., Ltd.) | 0.3 pt. wt. |
| Talc (Y/X = 0.03, manufactured by Nippon Talc Co., Ltd.) | 0.2 pt. wt. |
| Methyl ethyl ketone | 33.0 pts. wt. |
| Toluene | 33.0 pts. wt. |

Next, coating liquid 1 for protective layer was gravure coated at a coverage of 2 g/m$^2$ (on a dry basis) on the surface of the polyethylene terephthalate film remote from the backside layer. The coating was dried at 110° C. for 60 sec to form a thermally transferable protective layer. Thus, a protective layer transfer sheet of the present invention was prepared.

EXAMPLE I-2

A backside layer (thickness 1 μm) was formed on a 6 μm-thick polyethylene terephthalate film (6FK203E, manufactured by Diafoil Hoechst Co., Ltd.) in its nonadhesive side in the same manner as in Example I-1.

The coating liquid for a release layer was then gravure coated at a coverage on a dry basis of 0.5 g/m$^2$ on the substrate sheet in its adhesive side remote from the backside layer, and the coating was dried (110° C./60 sec). Thereafter, coating liquid 2 for a protective layer was coated on the release layer at a coverage on a dry basis of 2 g/m$^2$, and the coating was dried (110° C./60 sec) to form a thermally transferable protective layer. Thus, a protective layer transfer sheet of the present invention was prepared.

EXAMPLE I-3

A protective layer transfer sheet of the present invention was prepared in the same manner as in Example I-1, except that coating liquid 3 for a protective layer was used instead of coating liquid 1 for a protective layer.

EXAMPLE I-4

A protective layer transfer sheet of the present invention was prepared in the same manner as in Example I-2, except that coating liquid 4 for a protective layer was used instead of coating liquid 2 for a protective layer.

EXAMPLE I-5

A protective layer transfer sheet of the present invention was prepared in the same manner as in Example I-1, except that coating liquid 5 for a protective layer was used instead of coating liquid 1 for a protective layer.

EXAMPLE I-6

A protective layer transfer sheet of the present invention was prepared in the same manner as in Example I-2, except that coating liquid 6 for a protective layer was used instead of coating liquid 2 for a protective layer.

Comparative protective layers were then prepared.

Comparative Example I-1

A comparative protective layer transfer sheet was prepared in the same manner as in Example I-1, except that coating liquid 7 for a protective layer was used instead of coating liquid 1 for a protective layer.

Comparative Example I-2

A comparative protective layer transfer sheet was prepared in the same manner as in Example I-2, except that coating liquid 8 for a protective layer was used instead of coating liquid 2 for a protective layer.

Comparative Example I-3

A comparative protective layer transfer sheet was prepared in the same manner as in Example I-1, except that coating liquid 9 for a protective layer was used instead of coating liquid 1 for a protective layer.

Comparative Example I-4

A comparative protective layer transfer sheet was prepared in the same manner as in Example I-2, except that coating liquid 10 for a protective layer was used instead of coating liquid 2 for a protective layer.

Comparative Example I-5

A comparative protective layer transfer sheet was prepared in the same manner as in Example I-1, except that coating liquid 11 for a protective layer was used instead of coating liquid 1 for a protective layer.

Evaluation of Anti"Kick Back"

Preparation of Samples

① A thermal dye transfer sheet PK700L for a video printer CP-700 manufactured by Mitsubishi Electric Corporation was put on the top of another thermal dye transfer sheet PK700L so that the cyan dye side of one of the sheets faced the backside of the other sheet. The laminate was stored at 50° C. for 100 hr under a load of 2 kgf/cm$^2$ to kick off the cyan dye against the backside of the thermal dye transfer sheet PK700L.

② The backside against which the cyan dye had been kicked off was put on the surface of the protective layer in the protective layer transfer sheet. The laminate was stored at 60° C. for 4 hr under a load of 2 kgf/cm$^2$ to back the cyan dye against the surface of the protective layer.

Quantitative Determination

The density (O.D. value) of the surface of the protective layer before and after the backing of the cyan dye was measured with a Macbeth reflection densitometer manufactured by Sakata INX Corp., and a difference in density (ΔO.D.) was determined by the following equation:

$$\Delta O.D. = (O.D.\ value\ after\ backing) - (O.D.\ value\ before\ backing)$$

The anti"kick back" was evaluated according to the following criteria. The results are shown in Table 1.

Evaluation criteria

◎ (Very good): ΔO.D.≦0.03

○ (Good): 0.03<ΔO.D.≦0.06

Δ (Somewhat poor): 0.06≦ΔO.D.<≦0.09

X (Poor): 0.09<ΔO.D.

Formation of Image

A thermal dye transfer sheet PK700L for a video printer CP-700 manufactured by Mitsubishi Electric Corporation was provided as a thermal dye transfer sheet, and the image receiving sheet prepared above was provided as the thermal transfer image receiving sheet. The thermal dye transfer sheet and the image receiving sheet were put on top of each other so that the dye layer faced the dye receiving surface. Thermal transfer recording was carried out by applying a thermal head to the backside of the thermal transfer sheet under the following conditions to transfer dyes in the order of Y (yellow), M (magenta), and C (cyan) onto the image receiving sheet. Thus, a halftone image of gray was formed.

Printing Conditions

Thermal head: KGT-217-12MPL20 (manufactured by Kyocera Corp.)

Average resistance of heating element: 3195Ω

Printing density in scanning direction: 300 dpi

Printing density in feed direction: 300 dpi

Applied electric power: 0.12 W/dot

One line period: 5 msec

Printing initiation temp.: 40° C.

Gradation control: A test printer of a multi-pulse system was provided which had such a pulse length that one line period was divided into 256 equal parts and wherein the number of divided pulses could be varied from 0 to 255 during one line period. The duty ratio of each divided pulse was fixed at 60%, and, according to the gradation, the number of pulses per line period was increased stepwise in 17 increments from 0 to 255, that is, was 0 for step 0, 17 for step 1, and 34 for step 2. Thus, 16 gradations from step 0 to step 15 were controlled.

Transfer of Protective Layer

For the prints formed by the thermal transfer recording, the protective layer transfer sheets prepared in Examples I-1 to I-6 and Comparative Examples I-1 to I-5 were put on the top of the prints so that the surface of the protective layer faced the image received surface, followed by transfer of the protective layer over the whole surface of the prints by means of a thermal head under the following printing conditions.

Printing Conditions

Thermal head: KGT-217-12MPL20 (manufactured by Kyocera Corp.)

Average resistance of heating element: 3195Ω

Printing density in scanning direction: 300 dpi

Printing density in feed direction: 300 dpi

Applied electric power: 0.12 W/dot

One line period: 5 msec

Printing initiation temp.: 40° C.

Applied pulse: A test printer of a multi-pulse system was provided which had such a pulse length that one line period was divided into 256 equal parts and wherein the number of divided pulses could be varied from 0 to 255 during one line period. Solid printing was carried out with the duty ratio of each divided pulse being fixed at 60% and the number of pulses per line period being fixed to 210, followed by transfer of the protective layer over the whole surface of the prints.

Lightfastness of Prints

For the prints with the protective layer transferred thereon, a light fastness test was carried out using a xenon Fade-O-Meter under the following conditions.

Irradiation tester: Ci 35 manufactured by Atlas

Light source: xenon lamp

Filter: inside=IR filter
outside=soda lime glass

Black panel temp.: 45° C.

Irradiation intensity: 1.2 W/m$^2$ as measured at 420 nm

Irradiation energy: 400 kJ/m$^2$ in terms of integrated value at 420 nm

Subsequently, the optional reflection density of the Cy component in the gray image was measured with an optical densitometer (Macbeth RD-918, manufactured by Macbeth) through a red filter. In this case, for the step with the optical reflection density before the irradiation being around 1.0, a difference in optical density between before and after the irradiation was determined, and the retention of the optical density was calculated by the following equation:

Retention (%)=(optional reflection density after irradiation/optical reflection density before irradiation) ×100

The light fastness of the prints was evaluated according to the following criteria. The results are shown in Table 1.

Evaluation criteria

⊙ (very good): Retention of not less than 80%

○ (Good): Retention of 70 to less than 80%

Δ (Somewhat poor): Retention of 60 to less than 70%

X (Poor): Retention of less than 60%

Transferability of Protective Layer

Prints with the protective layer transferred thereon were visually inspected for the presence of an extra protective layer portion in a portion other than the predetermined transfer portion, and the transferability of the protective layer was evaluated according to the following criteria. The results are shown in Table 1.

Evaluation criteria

○ (Good): Substantially no extra protective layer portion was present on the periphery of the predetermined transfer portion, indicating good transferability.

Δ (Somewhat poor): An extra protective layer portion was present on a part of the periphery of the predetermined transfer portion.

X (Poor): An extra protective layer portion was present on the whole periphery of the predetermined transfer portion, indicating bad transferability.

TABLE 1

| Protective layer transfer sheet | Anti-"kick back" | Light fastness of print | Transferability of protective layer | Overall evaluation |
|---|---|---|---|---|
| Example I-1 | ⊙ | ○ | ○ | ○ |
| Example I-2 | Δ | ○ | Δ | ○ |
| Example I-3 | Δ | ○ | ○ | ○ |
| Example I-4 | Δ | ⊙ | Δ | ○ |
| Example I-5 | Δ | ⊙ | ○ | ○ |
| Example I-6 | ⊙ | ⊙ | ○ | ○ |
| Comp. Example I-1 | Δ | X | X | X |
| Comp. Example I-2 | Δ | X | Δ | X |
| Comp. Example I-3 | Δ | Δ | X | X |
| Comp. Example I-4 | X | X | ○ | X |
| Comp. Example I-5 | Δ | X | X | X |

As is apparent from Table 1, all the protective layer transfer sheets of the present invention (Examples I-1 to I-6) possessed excellent anti"kickback" and transferability, and the prints provided with the protective layer formed using the protective layer transfer sheets had good light fastness.

By contrast, for the comparative protective layer transfer sheets (Comparative Examples I-1 to I-5), at least one of the anti"kick back" and the transferability was poor, and the prints provided with the protective layer formed using the comparative protective layer transfer sheets also had poor light fastness, and could not be put to practical use.

Experiment II

Preparation of Resin Compositions

At the outset, the following polyester resin (PEs-1) was prepared by a conventional method.

| PEs-1: Tg = 92° C., viscosity average molecular weight = 5,000) | |
|---|---|
| Diethylene glycol | 10 mol % |
| Tricyclodecanedimethanol (TCD-M) | 90 mol % |
| Terephthalic acid | 50 mol % |
| Isophthalic acid | 50 mol % |

A random copolymer (PC-1: Tg=130° C., viscosity average molecular weight=22,400) comprising 40% by mole of constituent units represented by formula (3) and 60% by mole of constituent units represented by formula (4) was prepared by a conventional method:

(3)

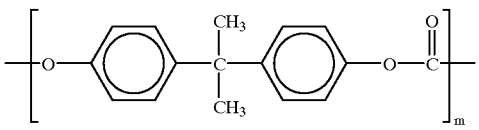

-continued (4)

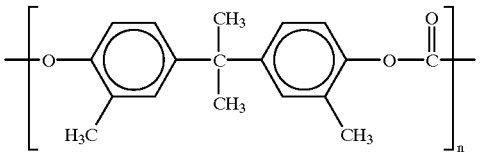

Preparation of Thermal Transfer Image Receiving Sheet

A 150 μm-thick synthetic paper (YUPO FPG#150, manufactured by Oji-Yuka Synthetic Paper Co., Ltd.) was provided as a substrate sheet. A coating liquid, for a receptive layer, having the following compositions was coated on one side of the substrate sheet by wire bar coating (coverage 5.0 g/m$^2$ on solid basis), and the coating was dried at 110° C. for 30 sec. Thus, a thermal transfer image receiving sheet was prepared.

| Coating liquid for receptive layer | |
|---|---|
| Vinyl chloride/vinyl acetate copolymer (Denka Vinyl #1000A, manufactured by Denki Kagaku Kogyo K.K.) | 10 pts. wt. |
| Epoxy-modified silicone (X-22-3000T, manufactured by The Shin-Etsu Chemical Co., Ltd) | 1 pt. wt. |
| Methyl ethyl ketone/toluene = 1/1 (weight ratio) | 40 pts. wt. |

Preparation of Protective Layer Transfer Sheets

EXAMPLE II-1

An ink, for a backside layer, having the following composition was coated by gravure coating on one side of a 6 μm-thick polyethylene terephthalate film (Lumirror, manufactured by Toray Industries, Inc.). The coating was then dried and heat-cured to form a backside layer (thickness 1 μm).

| Ink for backside layer | |
|---|---|
| Polyvinyl butyral resin (S-lec BX-1, manufactured by Sekisui Chemical Co., Ltd.) | 3.6 pts. wt. |
| Polyisocyanate (Burnock D750-45, manufactured by Dainippon Ink and Chemicals, Inc.) | 19.2 pts. wt. |
| Phosphoric ester surfactant (Plysurf A208S, manufactured by Dai-Ichi Kogyo Seiyaku Co., Ltd.) | 2.9 pts. wt. |
| Phosphoric ester surfactant (Phosphanol RD720, manufactured by Toho Chemical Industry Co., Ltd.) | 0.3 pt. wt. |
| Talc (Y/X = 0.03, manufactured by Nippon Talc Co., Ltd.) | 0.2 pt. wt. |
| Methyl ethyl ketone/Toluene = 1/1 (weight ratio) | 66.0 pts. wt. |

Coating liquid 12, for a protective layer, having the following composition was gravure coated on the polyethylene terephthalate film in its side remote from the backside layer at a coverage on a dry basis of 2 g/m$^2$, and the coating was then dried (110° C./60 sec) to form a thermally transferable protective layer. Thus, a protective layer transfer sheet of the present invention was prepared.

| Coating liquid 12 for protective layer | |
|---|---|
| Polyester resin (Toporex 550–51, manufactured by Mitsui Chemicals Inc.) | 15 pts. wt. |
| 2-(2-Hydroxy-3,5-di-t-butylphenyl)-5-chloro-benzotriazole | 6 pts. wt. |
| Methyl ethyl ketone/toluene = 1/1 (weight ratio) | 79 pts. wt. |

EXAMPLE II-2

A backside layer (thickness 1 μm) was formed on a 6 μm-thick polyethylene terephthalate film (6FK203E, manufactured by Diafoil Hoechst Co., Ltd.) in its nonadhesive side in the same manner as in Example II-1.

The coating liquid, for a release layer, having the following composition was then gravure coated at a coverage on a dry basis of 0.5 g/m$^2$ on the substrate sheet in its adhesive side remote from the backside layer, and the coating as dried (110° C./60 sec). Thereafter, coating liquid 13, for a protective layer, having the following composition was coated on the release layer at a coverage on a dry basis of 2 g/m$^2$, and the coating was dried (110° C./60 sec) to form a thermally transferable protective layer. Thus, a protective layer transfer sheet of the present invention was prepared.

| Coating liquid 12 for release layer | |
|---|---|
| Ionomer resin (manufactured by Mitsui Chemical Co. Ltd.) | 10 pts. wt. |
| Water/ethanol = 2/3 (weight ratio) | 100 pts. wt. |
| **Coating liquid 13 for protective layer** | |
| Polyvinyl butyral resin (S-lec BX-1,manufactured by Sekisui Chemical Co., Ltd.) | 15 pts. wt. |
| 2-(2-Hydroxy-3,5-di-t-amylphenyl)-benzotriazole | 6 pts. wt. |
| Methyl ethyl ketone/toluene = 1/1 (weight ratio) | 79 pts. wt. |

EXAMPLE II-3

A protective layer transfer sheet of the present invention was prepared in the same manner as in Example II-1, except that coating liquid 14, for a protective layer, having the following composition was used instead of coating liquid 12 for a protective layer.

| Coating liquid 14 for protective layer | |
|---|---|
| Polyester resin (PEs-1) | 15 pts. wt. |
| 2-[2-Hydroxy-3,5-bis(α,α-di-methylbenzyl)-phenyl]-2H-benzotriazole | 6 pts. wt. |
| Methyl ethyl ketone/toluene = 1/1 (weight ratio) | 79 pts. wt. |

EXAMPLE II-4

A protective layer transfer sheet of the present invention was prepared in the same manner as in Example II-2, except that coating liquid 15, for a protective layer, having the following composition was used instead of coating liquid 13 for a protective layer.

| Coating liquid 15 for protective layer | |
|---|---|
| Acrylic resin (Dianal BR-85, manufactured by Mitsubishi Rayon Co., Ltd. | 12 pts. wt. |
| Acrylic copolymer as ultraviolet absorber (UVA 635L, manufactured by BASF Japan) | 3 pts. wt. |
| 2-(2-Hydroxy-3,5-di-t-butylphenyl)-benzotriazole | 6 pts. wt. |
| Methyl ethyl ketone/toluene = 1/1 (weight ratio) | 79 pts. wt. |

EXAMPLE II-5

A protective layer transfer sheet of the present invention was prepared in the same manner as in Example II-1, except that coating liquid 16, for a protective layer, having the following composition was used instead of coating liquid 12 for a protective layer.

| Coating liquid 16 for protective layer | |
|---|---|
| Polycarbonate resin (PC-1) | 18 pts. wt. |
| 2-(2-Hydroxy-3,5-di-t-butylphenyl)-benzotriazole | 2 pts. wt. |
| Methyl ethyl ketone/toluene = 1/1 (weight ratio) | 80 pts. wt. |

EXAMPLE II-6

A protective layer transfer sheet of the present invention was prepared in the same manner as in Example II-2, except that coating liquid 17, for a protective layer, having the following composition was used instead of coating liquid 13 or a protective layer.

| Coating liquid 17 for protective layer | |
|---|---|
| Polycarbonate resin (PC-1) | 12 pts. wt. |
| 2-(2-Hydroxy-3,5-di-t-butylphenyl)-benzotriazole | 8 pts. wt. |
| Methyl ethyl ketone/toluene = 1/1 (weight ratio) | 79 pts. wt. |

EXAMPLE II-7

A protective layer transfer sheet of the present invention was prepared in the same manner as in Example II-1, except that coating liquid 18, for a protective layer, having the following composition was used instead of coating liquid 12 for a protective layer.

| Coating liquid 18 for protective layer | |
|---|---|
| Polycarbonate resin (PC-1) | 5 pts. wt. |
| Polyester resin (PEs-1) | 7 pts. wt. |
| Acrylic copolymer as ultraviolet absorber (UVA 635L, manufactured by BASF Japan) | 3 pts. wt. |
| 2-(2-Hydroxy-3,5-di-t-butylphenyl)-benzotriazole | 3 pts. wt. |
| 2-[2-Hydroxy-3,5-bis(α,α-di-methylbenzyl)-phenyl]-2H-benzotriazole | 3 pts. wt. |

-continued

| | |
|---|---|
| Methyl ethyl ketone/toluene = 1/1 (weight ratio) | 79 pts. wt. |

EXAMPLE II-8

A backside layer (thickness 1 μm) was formed on a 6 μm-thick polyethylene terephthalate film (6FK203E, manufactured by Diafoil Hoechst Co., Ltd.) as a substrate sheet in its nonadhesive side in the same manner as in Example II-1.

A release layer was formed on the substrate sheet in its adhesive side remote from the backside layer in the same manner as in Example II-2. A coating liquid, for a functional layer, having the following composition was coated at a coverage on a dry basis of 0.5 g/m$^2$ on the release layer, and the coating was dried at 110° C. for 60 sec. Thereafter, coating liquid 18, for a protective layer, as used in Example II-7 was coated on the functional layer at a coverage on a dry basis of 2 g/m$^2$, and the coating was dried at 110° C. for 60 sec to form a thermally transferable protective layer. Thus, a protective layer transfer sheet of the present invention was prepared.

| Coating liquid for functional layer | |
|---|---|
| Acrylic resin (Dianal BR-75, manufactured by Mitsubishi Rayon Co., Ltd. | 20 pts. wt. |
| Methyl ethyl ketone/toluene = 1/1 (weight ratio) | 80 pts. wt. |

Subsequently, comparative protective layer transfer sheets were prepared.

Comparative Example II-1

A comparative protective layer transfer sheet was prepared in the same manner as in Example II-1, except that coating liquid 19, for a protective layer, having the following composition was used instead of coating liquid 12 for a protective layer.

| Coating liquid 19 for protective layer | |
|---|---|
| Polycarbonate resin (PC-1) | 15 pts. wt. |
| 2-(2-Hydroxy-5-methylphenyl)-benzotriazole | 6 pts. wt. |
| Methyl ethyl ketone/toluene = 1/1 (weight ratio) | 79 pts. wt. |

Comparative Example II-2

A comparative protective layer transfer sheet was prepared in the same manner as in Example II-2, except that coating liquid 20, for a protective layer, having the following composition was used instead of coating liquid 13 for a protective layer.

| Coating liquid 20 for protective layer | |
|---|---|
| Polycarbonate resin (PC-1) | 15 pts. wt. |
| 2-(2-Hydroxy-3-t-butyl-5-propionic acid octyl ester phenyl)benzotriazole | 6 pts. wt. |
| Methyl ethyl ketone/toluene = 1/1 (weight ratio) | 79 pts. wt. |

Comparative Example II-3

A comparative protective layer transfer sheet was prepared in the same manner as in Example II-1, except that coating liquid 21, for a protective layer, having the following composition was used instead of coating liquid 12 for a protective layer.

| Coating liquid 21 for protective layer | |
|---|---|
| Polycarbonate resin (PC-1) | 19 pts. wt. |
| 2-(2-Hydroxy-3,5-di-t-butylphenyl)-benzotriazole | 1 pt. wt. |
| Methyl ethyl ketone/toluene = 1/1 (weight ratio) | 80 pts. wt. |

Comparative Example II-4

A comparative protective layer transfer sheet was prepared in the same manner as in Example II-2, except that coating liquid 22, for a protective layer, having the following composition was used instead of coating liquid 13 for a protective layer.

| Coating liquid 22 for protective layer | |
|---|---|
| Polycarbonate resin (PC-1) | 10 pts. wt. |
| 2-(2-Hydroxy-3,5-di-t-butylphenyl)-benzotriazole | 10 pts. wt. |
| Methyl ethyl ketone/toluene = 1/1 (weight ratio) | 80 pts. wt. |

Formation of Image

A thermal dye transfer sheet PK700L for a video printer CP-700 manufactured by Mitsubishi Electric Corporation was provided as a thermal dye transfer sheet, and the image receiving sheet prepared above was provided as the thermal transfer image receiving sheet. The thermal dye transfer sheet and the image receiving sheet were put on top of each other so that the dye layer faced the dye receiving surface. Thermal transfer recording was carried out by applying a thermal head to the backside of the thermal transfer sheet under the following conditions to transfer dyes in the order of Y (yellow), M (magenta), and C (cyan) onto the image receiving sheet. Thus, a halftone image of gray was formed.

Printing conditions

Thermal head: KGT-217-12MPL20 (manufactured by Kyocera Corp.)

Average resistance of heating element: 3195Ω

Printing density in scanning direction: 300 dpi

Printing density in feed direction: 300 dpi

Applied electric power: 0.12 W/dot

One line period: 5 msec

Printing initiation temp.: 40° C

Gradation control: A test printer of a multi-pulse system was provided which had such a pulse length that one line period was divided into 256 equal parts and wherein the umber of divided pulses could be varied from 0 to 255 during one line period. The duty ratio of each divided pulse was fixed at 60%, and, according to the gradation, the number of pulses per line period was increased stepwise in 17 increments from 0 to 255, that is, was 0 for step 0, 17 for step 1, and 34 for step 2. Thus, 16 gradations from step 0 to step 15 were controlled.

Transfer of Protective Layer

For the prints formed by the thermal transfer recording, the protective layer transfer sheets prepared in Examples II-1 to II-8 and Comparative Examples II-1 to II-4 were put on the top of the prints so that the surface of the protective layer faced the image received surface, followed by transfer of the protective layer over the whole surface of the prints by means of a thermal head under the following printing conditions.

Printing conditions

Thermal head: KGT-217-12MPL20 (manufactured by Kyocera Corp.)

Average resistance of heating element: 3195Ω

Printing density in scanning direction: 300 dpi

Printing density in feed direction: 300 dpi

Applied electric power: 0.12 W/dot

One line period: 5 msec

Printing initiation temp.: 40° C.

Applied pulse: A test printer of a multi-pulse system was provided which had such a pulse length that one line period was divided into 256 equal parts and wherein the number of divided pulses could be varied from 0 to 255 during one line period. Solid printing was carried out with the duty ratio of each divided pulse being fixed at 60% and the number of pulses per line period being fixed to 210, followed by transfer of the protective layer over the whole surface of the prints.

Lightfastness of Prints

For the prints with the protective layer transferred thereon, a light fastness test was carried out using a xenon Fade-O-Meter under the following conditions.

Irradiation tester: Ci 35 manufactured by Atlas

Light source: xenon lamp

Filter: inside=IR filter
outside=soda lime glass

Black panel temp.: 45° C.

Irradiation intensity: 1.2 W/m$^2$ as measured at 420 nm

Irradiation energy: 400 kJ/m$^2$ in terms of integrated value at 420 nm

Subsequently, the optional reflection density of the Cy component in the gray image was measured with an optical densitometer (Macbeth RD-918, manufactured by Macbeth) through a red filter. In this case, for the step with the optical reflection density before the irradiation being around 1.0, a difference in optical reflection density between before and after the irradiation was determined, and the retention of the optical reflection density was calculated by the following equation:

Retention (%)=(optional reflection density after irradiation/optical reflection density before irradiation)×100

The light fastness of the prints was evaluated according to the following criteria. The results are shown in Table 2.

Evaluation criteria

⊙ (Very good): retention of not less than 80%

○ (Good): retention of 70 to less than 80%

Δ (Somewhat poor): retention of 60 to less than 70%

X (Poor): retention of less than 60%

Anti-Precipitation and Anti-Blocking Properties

For each of the protective layer transfer sheets prepared in Examples II-1 to II-8 and Comparative Examples II-1 to II-4, one sheet was put on the top of another sheet so that the protective layer side of the one sheet faced the backside of the another sheet. The laminate was sandwiched and held between 150 μm-thick synthetic papers (YUPO FPG#150, manufactured by Oji-Yuka Synthetic Paper Co., Ltd.). In this state, a load of 20 kg/cm$^2$ was applied to the assembly, and the assembly was allowed to stand in an oven of 60° C. for 4 hr. Thereafter, the protective layer side was separated from the backside, and the anti-precipitation and anti-blocking properties were evaluated according to the following criteria. The results are shown in Table 2.

Evaluation criteria

Anti-precipitation

○: UV absorber not precipitated.

X: UV absorber precipitated.

Anti-blocking

○: Not blocked.

X: Blocked.

TABLE 2

| Protective layer transfer sheet | Light fastness | Anti-precipitation | Anti-blocking | Overall evaluation |
|---|---|---|---|---|
| Example II-1 | ⊙ | ○ | ○ | ○ |
| Example II-2 | ⊙ | ○ | ○ | ○ |
| Example II-3 | ⊙ | ○ | ○ | ○ |
| Example II-4 | ⊙ | ○ | ○ | ○ |
| Example II-5 | ○ | ○ | ○ | ○ |
| Example II-6 | ⊙ | ○ | ○ | ○ |
| Example II-7 | ⊙ | ○ | ○ | ○ |
| Example II-8 | ⊙ | ○ | ○ | ○ |
| Comp. Example II-1 | Δ | X | ○ | X |
| Comp. Example II-2 | Δ | *1 | X | X |
| Comp. Example II-3 | X | ○ | ○ | X |
| Comp. Example II-4 | Δ | X | ○ | X |

*1: The protective layer transfer sheet prepared in Comparative Example II-2 suffered from blocking in the evaluation test on the anti-precipitation and anti-blocking properties, making it impossible to perform the evaluation of anti-precipitation.

As shown in Table 2, the protective layer transfer sheets of the present invention (Examples II-1 to II-8) had excellent anti-precipitation and anti-blocking properties, and the prints provided with protective layers formed using the protective layer transfer sheets had good light fastness.

By contrast, for the protective layer transfer sheet prepared in Comparative Example II-1, the light fastness was low due to unsatisfactory ultraviolet absorption, and, in addition, the UV absorber was likely to precipitate. For the protective layer transfer sheet prepared in Comparative Example II-2, the light fastness was low due to unsatisfactory ultraviolet absorption, and, in addition, blocking occurred. For the protective layer transfer sheet prepared in Comparative Example II-3, the lightfastness was poor due to excessively low content of the UV absorber. Further, for the protective layer transfer sheet prepared in Comparative Example II-4, the UV absorber precipitated due to excessively high content of the UV absorber. Thus, for all the comparative protective layer transfer sheets, at least one of the anti-precipitation, the anti-blocking, and the light fastness was poor, and these comparative protective layer transfer sheets could not be put to practical use.

What is claimed is:

1. A protective layer transfer sheet comprising: a substrate sheet; and a thermally transferable protective layer provided on at least a part of one side of the substrate sheet, the protective layer comprising an alicyclic polyester resin prepared using an alicyclic compound as at least one of a diol component and an acid component, wherein the protective layer contains a random copolymer of a reactive ultraviolet absorber with an acrylic monomer, said random copolymer having a glass transition temperature Tb of 60° C. or above and represented by formula (1):

(1)

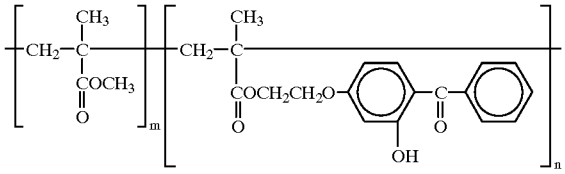

wherein m and n are each an integer.

2. The protective layer transfer sheet according to claim 1, wherein the alicyclic compound is selected from tricyclodecanedimethanol, cyclohexanedimethanol, cyclohexanediol, and cyclohexanedicarboxylic acid.

3. The protective layer transfer sheet according to claim 1, wherein the alicyclic polyester resin has a viscosity average molecular weight of 1,000 to 10,000 and a glass transition temperature Tg of 80° C. or above.

4. The protective layer transfer sheet according to claim 1, wherein the protective layer comprises a thermoplastic resin, with a glass transition temperature Tg of 80° C. or above, selected from acrylic resin, styrene resin, polyvinyl acetal resin, polycarbonate, and polyester resin other than the alicyclic polyester resin.

5. The protective layer transfer sheet according to claim 1, wherein the protective layer contains a benzotriazole ultraviolet absorber.

6. A print comprising: a substrate; and, provided on at least one side of the substrate, a dye image and a protective layer covering at least a part of the image, the protective layer having been formed by transfer from the protective layer transfer sheet according to claim 1.

7. A protective layer transfer sheet comprising: a substrate sheet; and a thermally transferable protective layer provided on at least a part of one side of the substrate sheet, the protective layer comprising a thermoplastic resin and an ultraviolet absorber, the ultraviolet absorber being a benzotriazole ultraviolet absorber represented by formula (2), the content of the ultraviolet absorber in the protective layer being 10 to 40% by weight:

(2)

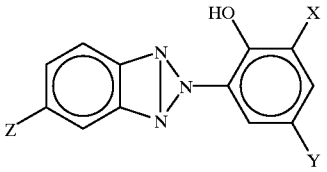

wherein X and Y each independently represent an optionally branched alkyl or aralkyl group having 4 to 10 carbon atoms and Z represents a hydrogen or chlorine atom.

8. The protective layer transfer sheet according to claim 7, wherein the thermoplastic resin has a glass transition temperature Tg of 80° C. or above and is selected from polyester resin, acrylic resin, styrene resin, polyvinyl acetal resin, and polycarbonate resin.

9. The protective layer transfer sheet according to claim 7, wherein the protective layer contains a random copolymer of a reactive ultraviolet absorber with an acrylic monomer, said random copolymer having a glass transition temperature Tg of 60° C. or above and represented by formula (1):

(1)

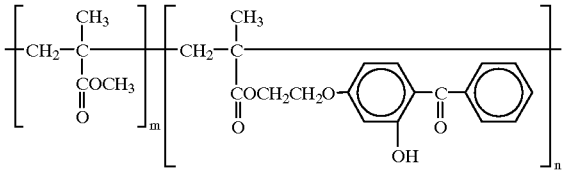

wherein m and n are each an integer.

10. A print comprising: a substrate; and, provided on at least one side of the substrate, a dye image and a protective layer covering at least a part of the image, the protective layer having been formed by transfer from the protective layer transfer sheet according to claim 7.

* * * * *